US011375744B2

(12) United States Patent
Kesselman et al.

(10) Patent No.: US 11,375,744 B2
(45) Date of Patent: Jul. 5, 2022

(54) CONE LOADING DEVICE AND METHOD THEREFOR

(71) Applicant: BBK TOBACCO & FOODS, LLP, Phoenix, AZ (US)

(72) Inventors: Joshua D. Kesselman, Vancouver (CA); Ian Kobe, Tempe, AZ (US)

(73) Assignee: BBK TOBACCO & FOODS, LLP, Phoenix, AZ (US)

( * ) Notice: Subject to any disclaimer, the term of this patent is extended or adjusted under 35 U.S.C. 154(b) by 422 days.

(21) Appl. No.: 16/209,392

(22) Filed: Dec. 4, 2018

(65) Prior Publication Data

US 2020/0170293 A1 Jun. 4, 2020

(51) Int. Cl.

| | |
|---|---|
| ***A24C 5/40*** | (2006.01) |
| ***A24C 5/02*** | (2006.01) |
| ***A24C 5/00*** | (2020.01) |

(52) U.S. Cl.

CPC ..... *A24C 5/40* (2013.01); *A24C 5/002* (2013.01); *A24C 5/02* (2013.01)

(58) Field of Classification Search

CPC .. A24C 5/40; A24C 5/02; A24C 5/002; A24C 5/54; A24D 1/022; A24B 7/04; A24F 15/00; A24F 17/00; B65D 85/10; B65D 85/12; B65D 43/00; B65D 25/00

See application file for complete search history.

(56) References Cited

U.S. PATENT DOCUMENTS

| | | | | |
|---|---|---|---|---|
| 4,303,082 | A | 12/1981 | Thompson et al. | |
| 4,887,617 | A | 12/1989 | Kiehn | |
| 2007/0181600 | A1* | 8/2007 | Ben-Shlomo | B65D 77/0446 222/142.9 |
| 2015/0298135 | A1* | 10/2015 | Spielman | B02C 18/08 241/101.01 |
| 2016/0213180 | A1* | 7/2016 | Javaruski | B65D 85/36 |
| 2017/0119043 | A1 | 5/2017 | Marshall et al. | |
| 2018/0055087 | A1 | 3/2018 | Collier et al. | |
| 2018/0303152 | A1* | 10/2018 | Douglas | A24C 5/02 |
| 2018/0310630 | A1* | 11/2018 | Kleizo | H05B 3/42 |

FOREIGN PATENT DOCUMENTS

| | | |
|---|---|---|
| CA | 2451375 | 12/2002 |
| CA | 2182651 | 11/2008 |
| DE | 3914669 | 7/1999 |

OTHER PUBLICATIONS

How To Fill 84mm JWare Cone Loader 420 Stock YouTube Date Published: May 18, 2017 Source: https://www.youtube.com/watch?v=OdeT_nhR9fk (Year: 2017).*

* cited by examiner

*Primary Examiner* — Michael J Felton

(74) *Attorney, Agent, or Firm* — Weiss & Moy, P.C.; Jeffrey D. Moy

(57) ABSTRACT

A device for loading and forming smoking articles has a body section. A first socket is formed in a top area of the body section. A second socket is formed in a bottom area of the body section. A plurality of channels is formed in a bottom area of the first socket and each configured to hold a smoking article. A plate is rotatable within the first socket to allow one to align a desired number of a plurality of openings with corresponding channels of the plurality of channels. A pin member secures the plate in position. A cap is insertable into the first socket when loading the smoking articles and into the second socket to push the smoking articles out of the channels when loaded.

19 Claims, 4 Drawing Sheets

CONE LOADING DEVICE AND METHOD THEREFOR

TECHNICAL FIELD

The present application relates generally to the technical field of tobacco and herbal smoking articles, and more specifically, to, the technical field of a device to load and form a user determined number of smoking articles using preformed conical paper wrappers.

BACKGROUND

Hand rolling smoking articles, such as cigarettes and the like, is a well-known practice. In one process, rolling paper may be formed into a cone and used to scoop up small amounts of ground smokable tobacco and/or herbs. The maker of the smoking article may then hold the open end of the cone upward allowing the small amount to fall into the cone. This process continues until a desired amount of ground smokable tobacco and/or herbs is held within the cone. The maker may use a rod or similar, object to compact the ground smokable tobacco and/or herbs into the cone. This process is repeated until the cone is filled and compacted with the desired amount of ground smokable tobacco and/or herbs. The open end of the cone is then sealed forming the smoking article.

Unfortunately, rolling individual smoking articles is time consuming. Further, rolling individual smoking articles may cause inconsistency in the smoking articles. This may be due to the smoking articles being unevenly filled and/or compacted with the ground smokable tobacco and/or herbs. Unevenly filling and/or compacting the ground smokable tobacco and/or herbs may adversely affect burn rates and temperatures of the smoking articles. That, in turn, can adversely affect the smoke flavors and result in the generation of unwanted combustion byproducts during the material burn.

Therefore, it would be desirable to provide a system and method that overcomes the above.

SUMMARY

In accordance with one embodiment, a device for loading and forming smoking articles is disclosed. The device for loading and forming smoking articles has a body section. A first socket is formed in a top area of the body section. A second socket is formed in a bottom area of the body section. A plurality of channels is formed in a bottom area of the first socket. The channels extend through the body section into the second socket. The channels are formed around a perimeter of the first socket and each configured to hold a smoking article. A tube is formed in a center area of the first socket. A plate has a plurality of openings. The plate is rotatable within the first socket to allow one to align, a desired number of the plurality of openings with corresponding channels of the plurality of channels. A pin opening is formed in a center area of the plate. The pin opening is aligned with the tube when the plate is inserted into the first socket. A pin member is insertable into the pin opening and the tube. The pin member secures the plate in position. A cap is insertable into the first socket when loading the smoking articles and into the second socket to push the smoking articles out of the channels when loaded In accordance with one embodiment, a device for loading and forming smoking articles is disclosed. The device for loading and forming smoking articles has a body section. A first socket is formed in a top area of the body section. A second socket is formed in a bottom area of the body section. A plurality of channels is formed in a bottom area of the first socket. The channels extend through the body section into the second socket. The channels are formed around a perimeter of the first socket and each configured to hold a smoking article. A tube is formed in a center area of the first socket A plate having a plurality of openings is rotatable within the first socket to allow one to align a selected number of the plurality of openings with corresponding channels of the plurality of channels allowing a desired number of the smoking articles to be loaded. The plate is removable allowing all of the plurality of channels to be filled with the smoking articles to be loaded. A pin opening is formed in a center area of the plate. The pin opening is aligned with the tube when the plate is inserted into the first socket. A pin member is removably insertable into the pin opening and the tube. The pin member secures the plate in position when inserted into the pin opening and the tube and compacts tobacco into the smoking articles when removed from the pin opening and the tube. A cap is insertable into the first socket, when loading the smoking articles and into the second socket to push the smoking articles out of the channels when loaded.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

The present disclosure relates to a device to load and form smoking articles using preformed conical paper wrappers. The device allows a user to select the number of smoking articles to form. Once the preformed conical paper wrappers are filled with a desired ground smokable tobacco and/or herbs (hereinafter tobacco), a cap device may be used to push the preformed conical paper wrappers out of the device.

Figure 2:
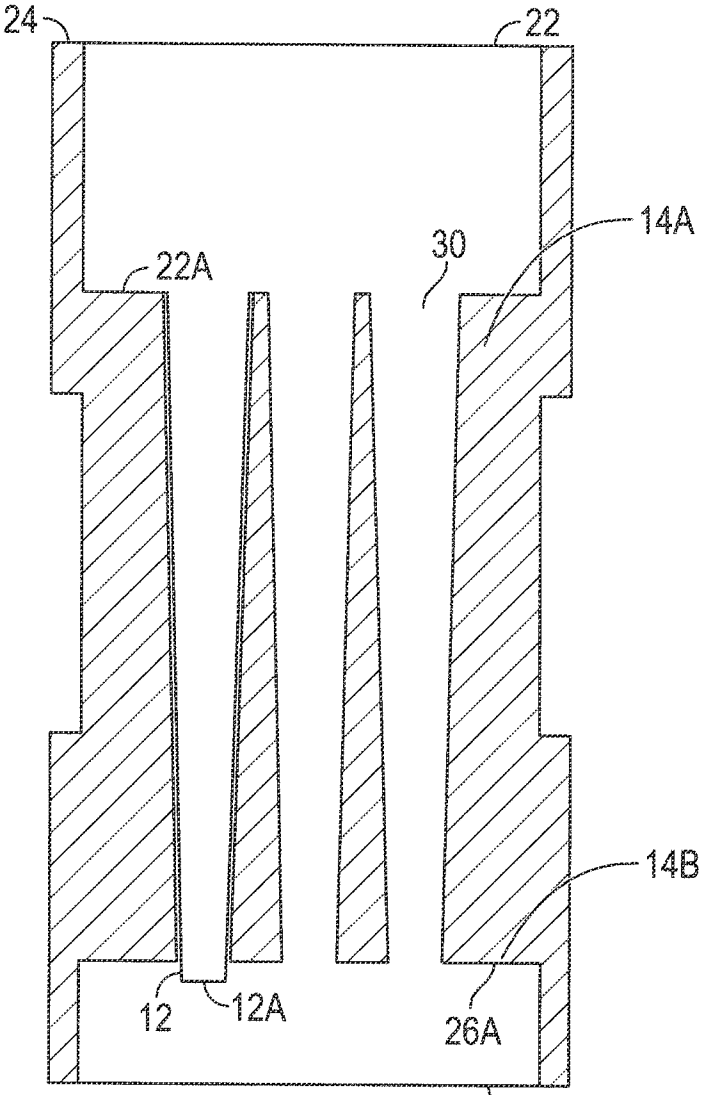
FIG. 2 is a cross-sectional view of the exemplary cone loading and forming device in accordance with one aspect of the present application.
Figure 1:
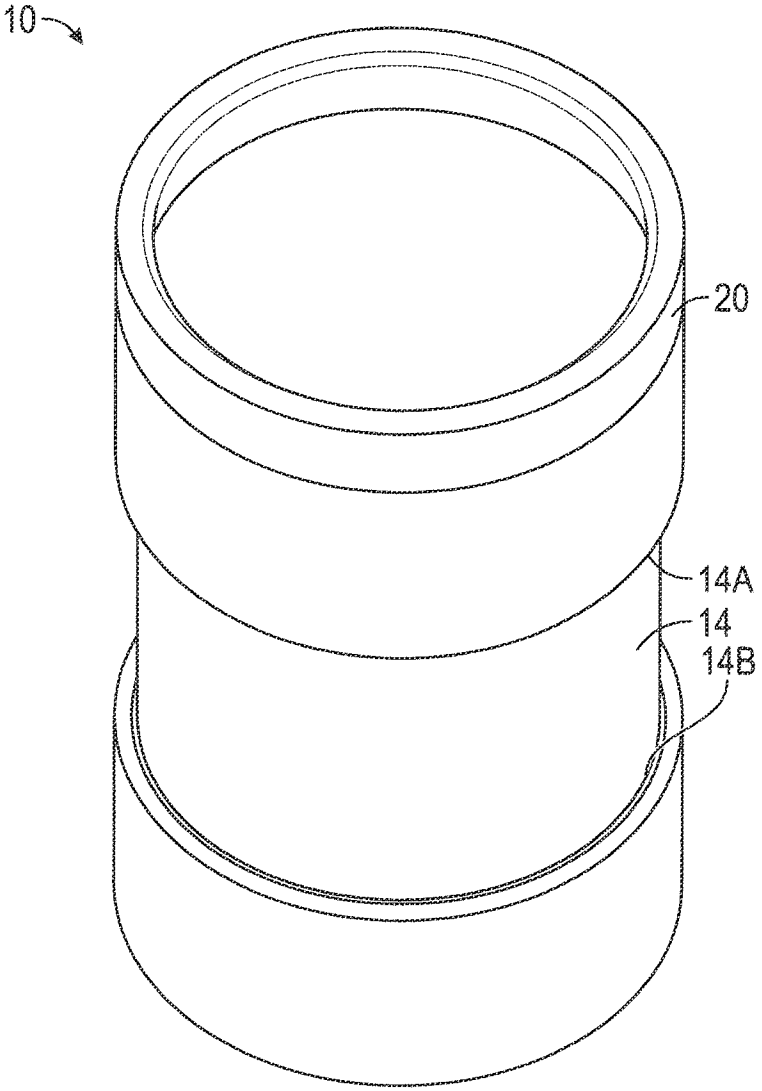
FIG. 1 is an elevated perspective view of an exemplary cone loading and forming device in accordance with one aspect of the present application.
Figure 4:
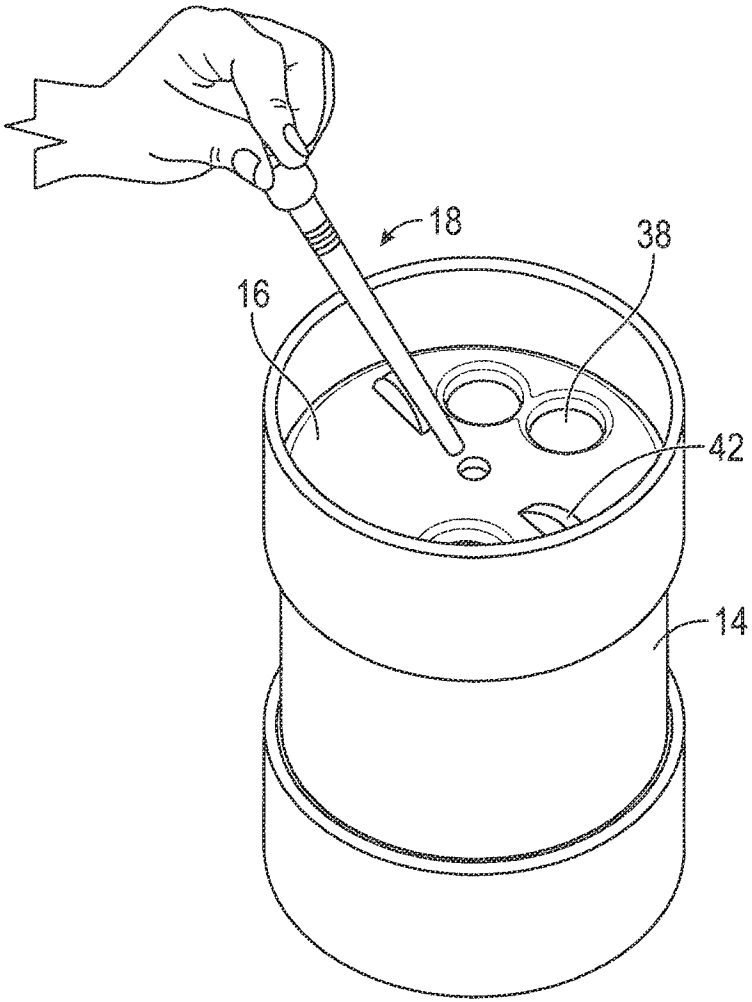
FIG. 4 is an elevated perspective view of an exemplary cone loading and forming device with the lid and pin removed, in accordance with one aspect of the present application.
Figure 3:
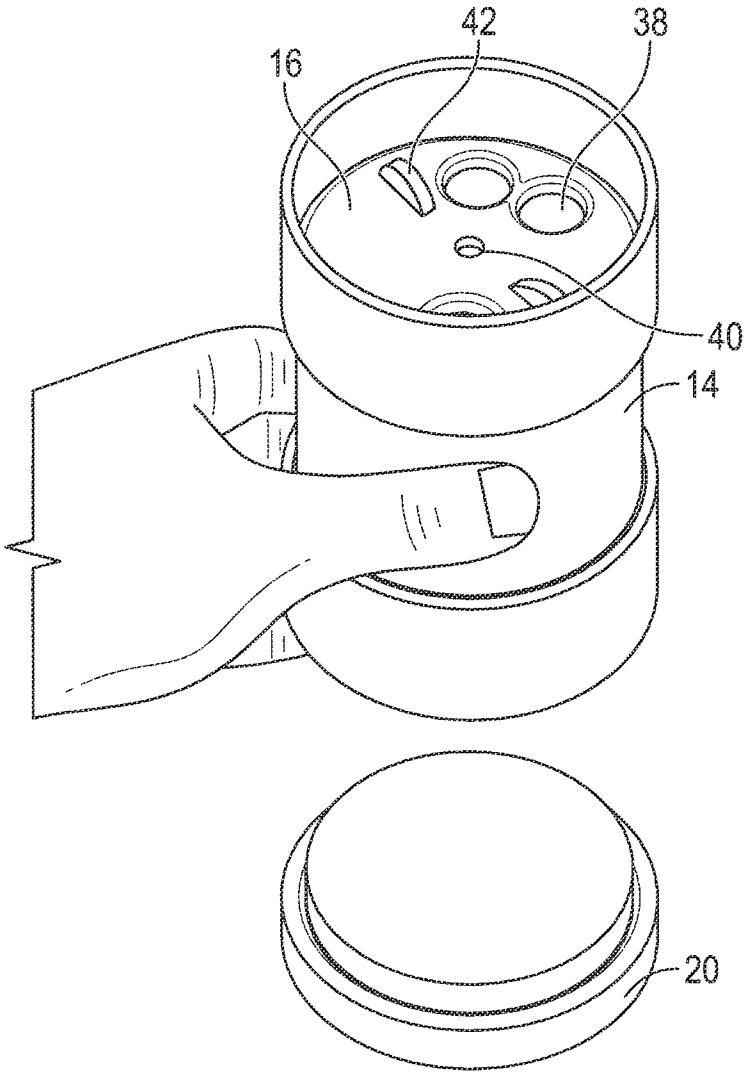
FIG. 3 is an elevated perspective view of an exemplary cone loading and forming device with the lid removed in accordance with one aspect of the present application.
Figure 5:
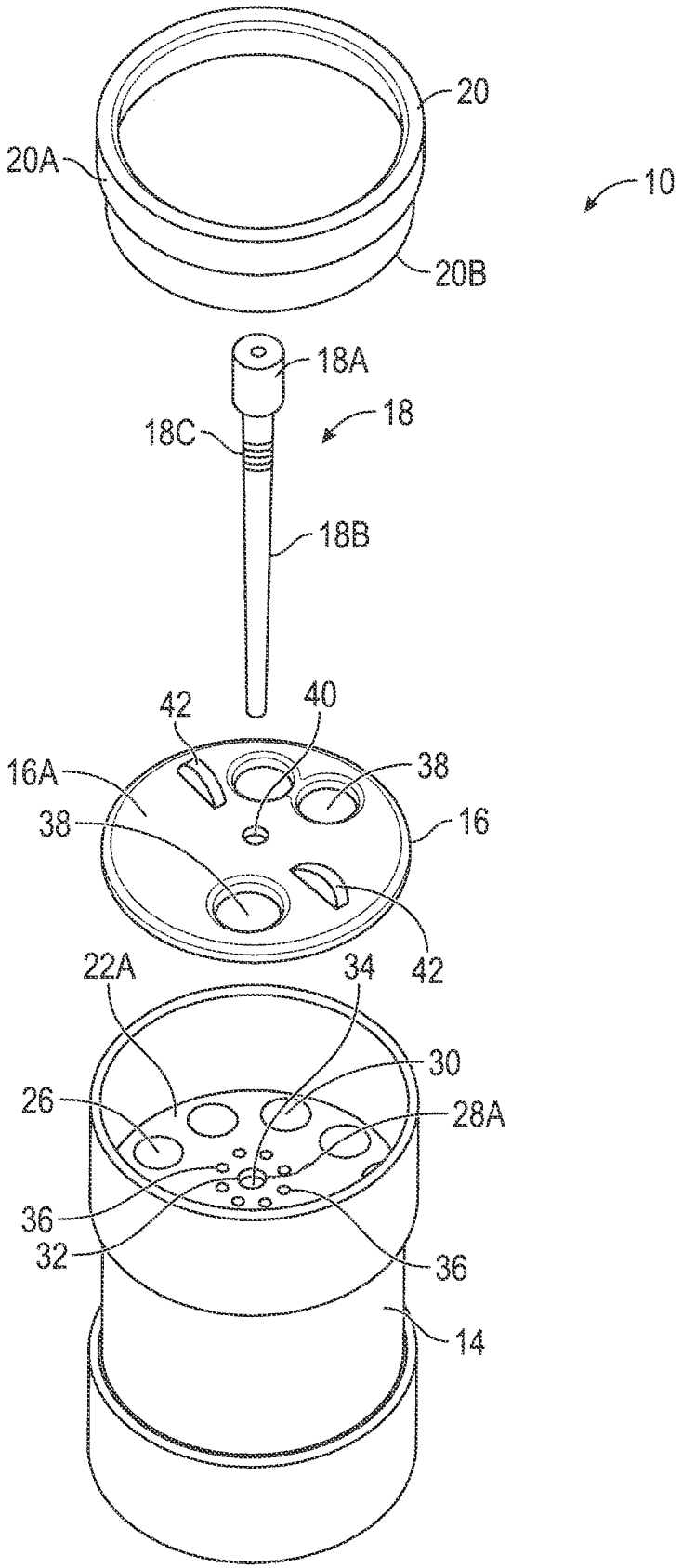
FIG. 5 is an exploded perspective view of an exemplary cone loading and forming device in accordance with one aspect of the present application.
Figure 6:
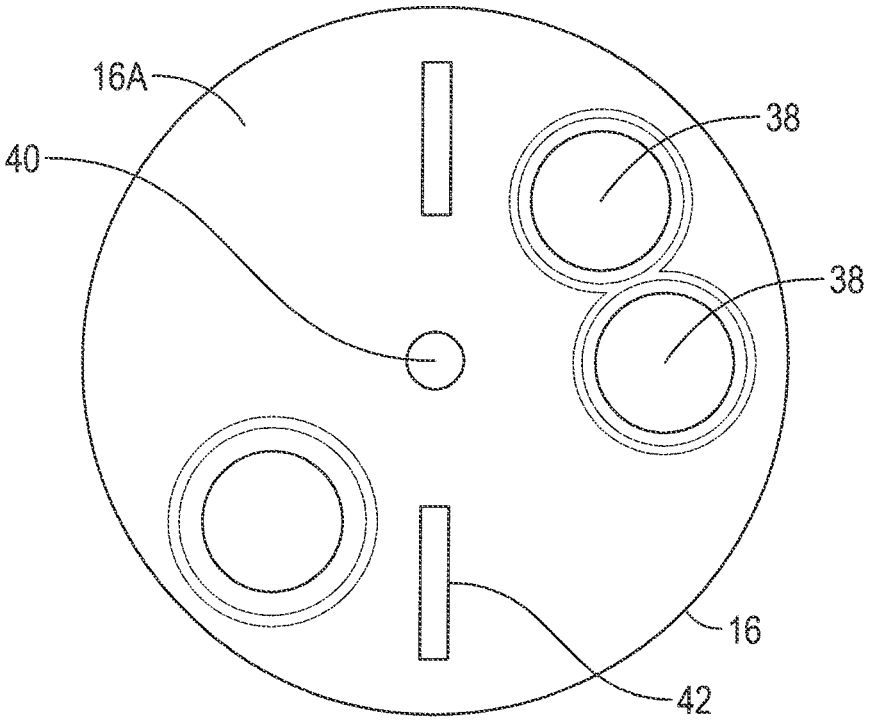
FIG. 6 is a top view of an exemplary plate of the cone loading and forming device in accordance with one aspect of the present application.
Figure 7:
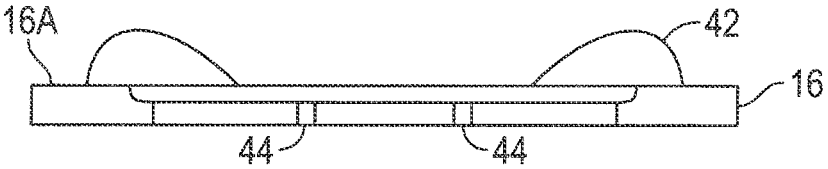
FIG. 7 is a side view of an exemplary plate of the cone loading and forming device in accordance with one aspect of the present application.

Referring to FIGS. 1-5 a device 10 for loading preformed conical paper wrappers 12 with tobacco may be seen. The device 10 may be formed of a body section 14. a plate 16, a pin member 18 and a cap 20.

The body section 14 may take on different geometric configurations. In accordance with the present embodiment, the body section 14 may be cylindrical in shape. However, this is shown as an example and should not be seen in a limiting manner.

A first socket 22 may be formed in a top area 14A of the body section 14. In the present embodiment, the first socket 22 may be cylindrical in form. The first socket 22 may be configured to have a radius less than that of the body section 14 thereby forming a ledge 24 around the top area 14A of the body, section 14. The first socket 22 may be configured to allow the cap 20 to be inserted therein. The first socket 22 may be formed of a depth to allow the cap 20 to be inserted therein as may be disclosed below.

A second socket 26 may be formed in a bottom area 14B of the body section 14. In the present embodiment, the second socket 26 may be cylindrical in form. The second socket 26 may be configured to have a radius less than that of the body section 14 thereby forming a ledge 28 around the bottom area 14B of the body section 14. The second socket 26 may be formed of a depth to allow the cap 20 to be inserted therein as may be disclosed below. In accordance with the embodiment shown, the first socket 22 may be formed having a depth greater than the second socket 26.

A plurality of channels 30 may be located at a bottom area 22A of the first socket 22 and extend through the body section 14 to a bottom area 26A of the second socket 26. In the present embodiment, the channels 30 may be conical in shape. Each channel 30 may be configured to hold one preformed conical paper wrapper 12 therein with a closed bottom section 12A of the preformed conical paper wrapper 12 extending out of the channel 30 and into the second socket 26.

A tube 32 may be located at a bottom area 22A of the first socket 22 and extend through a portion of the body section 14. The tube 32 may be located in the center of the bottom area 22A of the first socket 22. In the present embodiment, the tube 32 maybe cylindrical or slightly conical in shape. The tube 32 may be of a length to allow the pin member 18 to be inserted and held therein. The tube 32 may have threading 34 formed in a top area 28A of an interior the tube 32. The threading 34 may be used to secure the pin member 18 within the tube 3248.

A plurality of bumps 36 may be formed around a perimeter of the tube 32 along the bottom area 22A of the first socket 22. In accordance with one embodiment, the bumps 36 may be equally spaced around the perimeter of the tube 32.

The plate 16 may be sized to fit within the first socket 22. The plate 16 may have a diameter approximately the same as a diameter of the first socket 22. The plate 16 may be used to select a number of preformed conical paper wrappers 12 to load with tobacco. This may be done by rotating the plate 16 to expose one or more of the channels 30.

The plate 16 may have a plurality of openings 38 formed through a top surface 16A of the plate 16. in the present embodiment, three openings 38 may be seen. However, this is shown as one example. The openings 38 may be located around a perimeter of the plate 16. The openings 38 may be used to select a number of preformed conical paper wrapper 12 to load with tobacco. The plate 16 may be rotated to align one or more of the openings 38 with a corresponding channel of the plurality of channels 30. This may allow the user to selected the number preformed conical paper wrappers 12 to load with tobacco, Thus, in the present embodiment, the user may rotate the plate 16 to align 1, 2 or 3 of the openings 38 with a corresponding channel of the plurality of channels 30. If the user wishes to load more than 3 preformed conical paper wrappers 12, the user may remove the plate 16 and, expose all of the plurality of channels 30 to load preformed conical paper wrappers 12 with tobacco.

The plate 16 may have a pin opening 40 formed through a center area of the plate 16. When the plate 16 is positioned within the first socket 22, the pin opening 40 may be aligned with the tube 32. The pin member 18 may then be inserted through the pin opening 40 into the aligned tube 32 allowing the plate 16 to rotate about pin member 18.

One or more tabs 42 may be formed on and extend up from the top surface 16A of the plate 16. The tabs 42 may be used to aid the user in rotating the plate 16 within the first socket 22. The tabs 42 may also be used to aid the user in removing the plate 16 from the first socket 22.

Located on a bottom surface of the plate 16 may be a plurality of indentations 44. The indentations 44 may be formed around a perimeter of the pin opening 40. The indentations 44 may fit within corresponding bumps 36 to align and hold the plate 16 in position where one or more of the plurality of openings 38 align with a corresponding channel of the plurality of channels 30.

For example, rotating the plate 16 in a first position, the indentations 44 fit within corresponding bumps 36 so that only one of the plurality of openings 38 may align with a corresponding channel of the plurality of channels 30. The other openings 38 may be blocked/covered by the bottom area 22A of the first socket 22. This may prevent tobacco from entering any of the other of the plurality of channels 3046 not aligned with the one opening 38. Rotating the plate 16 in a second position, the indentations 44 fit within corresponding bumps 36 so that two of the plurality of openings 38 may align with two corresponding channels of the plurality of channels 30. The other opening 38 may be blocked/covered. This may prevent tobacco from entering any of the plurality of channels 30 not aligned with the two openings 38. Rotating the plate 16 in a third position, the indentations 44 fit within corresponding bumps 36 so that all three of the plurality of openings 38 may align with corresponding channels of the plurality of channels 30. The other channels 30 not aligned with the three openings 38 may be blocked. This may prevent tobacco from entering any of the plurality of channels 30 not aligned with the three openings 24.

The pin member 18 may be used for multiple purposes. As stated above, the pin member 18 may be inserted through the pin opening 40 into the aligned tube 32 allowing the plate 16 to rotate about pin member 18. The pin member 18 may also be used to lock the plate 16 down and prevent the plate 16 from moving as will be described below. The pin member 18 may further be used as, a poker to compact the tobacco in the conical paper wrapper 12. The pin member 18 may need to be removed from the pin opening 40 and the tube 32 in order to use the pin member 18 as a poker as may be described below.

The pin member 18 may be formed of a head 18A. The head 18A may be of a size larger Hiatt the pin opening 40. This may prevent the pin member 18 from falling through the pin opening 40 and completely into the aligned tube 32. A shaft 18B may extend down from the head 18A. The shaft 18B may be configured to slide within, the aligned tube 32. In accordance with one embodiment, the shaft 18B may be cylindrical or slightly conical in shape.

Threading 18C may be formed on the shaft 18B. The threading 18C may be formed in an upper region of the shaft 18B. When the pin member 18 is inserted through the pin opening 40 into the aligned tube 32, the pin member 18 may be rotated in a first direction so that the threading 18C may engage the threading 34 formed in the top area of the interior the tube 32. Continued rotation of the pin member 18 may cause the head ISA of the pin member 18 to press down against the plate 16 to lock the plate 16 down and prevent the plate 16 from moving. The pin member 18 may be rotated in a second direction so that the threading 18C may disengage the threading 34 formed in the top area of the interior the tube 32 thereby allowing one to rotate the plate 16 and/or remove the pin member 18 from the pin opening 40 and the aligned tube 32.

The cap 20 may be used for multiple purposes. The cap 20 may be used to seal the first socket 22 and to prevent tobacco placed in the first socket 22 from escaping. The cap 20 may also be used to push the preformed conical paper wrappers 12 out from the plurality of channels 30. By inserting the cap 20 into the second socket 30, the cap 20 may push the portion of the preformed conical paper wrappers 12 extending into the second socket 30 up thereby pushing an upper part of the preformed conical paper wrappers 1.2 out of the plurality of channels 30.

The cap 20 may have a head section 20A. A stopper 208 may extend down from the head section 20A. The stopper 208 may be configured to have the same diameter as the first socket 22 and the second socket 26. This may allow the cap to be inserted into first socket 22 or the second socket 26 and held therein. In accordance with one embodiment, the stopper 20B may be cylindrical in shape.

In operation, a user may loosen the pin member 18 by rotating the pin member 18 in a loosening direction. The user may then rotate the plate. 16 to select the number of preformed conical paper wrappers 12 to load. In the present embodiment, the user may rotate the plate 16 so that 1, 2, or 3 openings may align with a corresponding channel of the plurality of channels 30. If the user desires to load all of the plurality of channels 30 with preformed conical paper wrappers the user may rotate the pin member 18 in the loosening direction to disengage the threading 18C from the threading 34 formed in the top area of the interior of the tube 32. The user may then remove the pin, member 18 from the pin opening 40 and the tube 32. With the pin member 18 removed, the user may remove the plate 16 to expose all of the plurality of channels 30. It should be noted if the pin member 18 is removed in order to remove the plate 16, the pin member 18 should be placed back into the tube 28 thereby preventing any debris from entering into the tube 28 prior to loading any of the preformed conical paper wrappers 12 with tobacco.

Once the user has selected the number of preformed conical paper wrappers 12 to form, the user may rotate the pin member 18 in a tightening direction to lock the plate 16 in position if the plate 16 has not been removed. The user ay insert the preformed conical paper wrappers 12 to load into all the exposed channels 30. Tobacco may then be placed into the first socket 22. The amount of tobacco placed in the first socket 22 should be sufficient to fill the number of conical paper wrappers 12 placed into the exposed channels 30.

Once the tobacco is placed in the first socket 22, the cap 20 may be placed in the first socket 22. The cap 20 may be positioned in the, first socket 22 such that the stopper 20B may be inserted into the first socket 22 thereby preventing tobacco from exiting the first socket 22. With the cap 20 inserted into the first socket 22, the user may pick-up the device 10 and bang a bottom surface of the device 10 against a hard surface. The hard surface may be a table top, the floor or similar surfaces. When banging the bottom surface of the device 10 against the hard surface, the user may want to hold the cap 20 to ensure that the cap 20 does not fly out of the first socket 22. The banging of the device 10 may aid in settling the tobacco into a bottom section of each of the conical paper wrappers 12 placed into the exposed channels 30.

The user may then remove the cap 20. The cap 20 may then be inserted into the second socket 26. By placing the stopper 20B of the cap 20 into the second socket 26, the stopper 20B may push the portion of the preformed conical paper wrappers 12 extending into the second socket 26 up thereby pushing an upper part of the preformed conical paper wrappers 12 out of the channels 30. The user may then remove the pin member 18 to compact the tobacco into the preformed conical paper wrappers 12. The open end of the preformed conical paper wrappers 12 is then sealed forming the smoking article.

The foregoing description is illustrative of particular embodiments of the application, but is not meant to be a limitation upon the practice thereof. The following claims, including all equivalents thereof, are intended to define the scope of the application.

What is claimed is:

1. A device for loading and forming smoking articles comprising:

a body section;

a first socket formed in a top area of the body section;

a second socket formed in a bottom area of the body section;

a plurality of channels formed in a bottom area of the first socket, the channels extending through the body section into the second socket, the channels formed around a perimeter of the first socket and each configured to hold a smoking article; a tube formed in a center area of the first socket;

a plate having a plurality of openings, the plate rotatable within the first socket, the plate rotatable to a first position wherein only one of the plurality of openings is aligned with a corresponding channel and remaining channels of the plurality of channels are covered by the plate, the plate rotatable to a second position wherein two of the plurality of openings are aligned with two corresponding channels and non-corresponding channels to the two corresponding channels are covered by the plate, the plate rotatable to a third position wherein three of the plurality of openings are aligned with three corresponding channels and non-corresponding channels to the three corresponding channels are covered by the plate, wherein the plate is removable from the first socket allowing all of the plurality of channels to be filled thereby allowing one to select a desired number of channels to be filled at one time;

a pin opening formed in a center area of the plate and having a pin opening threading formed within an interior thereof, the pin opening aligned with the tube when the plate is inserted into the first socket;

a pin member having a pin head formed on a top of the pin member and sized to be larger than the pin opening preventing the pin member from falling completely into the tube and a pin member threading formed around an upper perimeter of the pin member and insertable into the pin opening and the tube, the pin member locking the plate in position and preventing the plate from rotating when the pin member threading of the pin member engages the pin opening threading of the pin opening, the pin member used as a compactor when removed from the pin opening and the tube, the pin head and pin member preventing contents used to fill the channels from entering the pin opening and tube; and a cap insertable into the first socket when loading the smoking articles and into the second socket to push the smoking articles out of the channels when loaded.

2. The device of claim 1, wherein each of the plurality of channels is conical.

3. The device of claim 1, wherein the first socket and the second socket are cylindrical.

4. The device of claim 1, wherein each of the plurality of channels are conical in shape.

5. The device of claim 1, wherein the tube is a depth to allow the pin member to be inserted therein with a top section of the pin member extending above a bottom of the first socket.

6. The device of claim 1, comprising a plurality of bumps formed around the tube.

7. The device of claim 6, wherein the plate has a plurality of indentations formed on a bottom surface of the plate, the indentations formed around the pin opening, the indentations fit within corresponding bumps to secure the plate in position.

8. The device of claim 1, comprising at least one tab formed on a top surface of the plate.

9. The device of claim 1, wherein the pin ember comprises:

a head member, and a shaft extending down from the head member.

10. The device of claim 1, wherein the cap comprises a head section; and stopper extending down from the head section.

11. A device for loading and forming smoking articles comprising:

a body section;

a first socket formed in a top area of the body section;

a second socket formed in a bottom area of the body section;

a plurality of channels formed in a bottom area of the first socket, the channels extending through the body section into the second socket, the channels formed around a perimeter of the first socket and each configured to hold a smoking article;

a tube formed in a center area of the first socket;

a plate having a plurality of openings, the plate rotatable within the first socket to a first position wherein only one of the plurality of openings is aligned with a corresponding channel and remaining channels of the plurality of channels are covered by the plate, the plate rotatable to a second position wherein two of the plurality of openings are aligned with two corresponding channels and non-corresponding channels to the two corresponding channels are covered by the plate, the plate rotatable to a third position wherein three of the plurality of openings are aligned with three corresponding channels and non-corresponding channels to the three corresponding channels are covered by the plate, wherein the plate is removable from the first socket allowing all of the plurality of channels to be filled thereby allowing one to select a desired number of channels to be filled at one time;

a pin opening formed in a center area of the plate, the pin opening aligned with the tube when the plate is inserted into the first socket;

a pin member, a pin head formed on a top of the pin member and sized to be larger than the pin opening preventing the pin member from failing completely into the tube and removably insertable into the pin opening and the tube, the pin member rotatable within the pin opening securing and locking the plate in position when inserted into the pin opening and the tube and compacting tobacco into the smoking articles when removed from the pin opening and the tube; and a cap insertable into the first socket when loading the smoking articles and into the second socket to push the smoking articles out of the channels when loaded.

12. The device of claim 11, wherein each of the plurality of channels are conical in shape.

13. The device of claim 11, comprising a plurality of bumps formed around the tube.

14. The device of claim 13, wherein the plate has a plurality of indentations formed on a bottom surface of the plate, the indentations formed around the pin opening, the indentations fit within corresponding bumps to secure the plate in position.

15. The device of claim 11, comprising at least one tab formed on a top surface of the plate.

16. The device of claim 11, wherein the pin member comprises:

a head member, and a shaft extending down from the head member.

17. The device of claim 16, comprising:

a first threading formed on the shaft; and a second threading formed in an interior of the tube.

18. The device of claim 11, wherein the cap comprises:

a head section; and a stopper extending down from the head section.

19. The device of claim 1, wherein the plurality of openings comprises:

a pair of openings formed on a first half of the plate, wherein each opening of the pair of openings is adjacent to one another; and a third opening formed on a second half of the plate.

* * * * *